US011397066B1

(12) United States Patent
Oglesby

(10) Patent No.: US 11,397,066 B1
(45) Date of Patent: Jul. 26, 2022

(54) MUZZLE DEVICE AND BLAST SLEEVE

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 17/223,110

(22) Filed: Apr. 6, 2021

Related U.S. Application Data

(60) Provisional application No. 63/005,595, filed on Apr. 6, 2020.

(51) Int. Cl.
*F41A 21/34* (2006.01)
*F41A 21/36* (2006.01)
*F41A 21/32* (2006.01)

(52) U.S. Cl.
CPC ..... *F41A 21/34* (2013.01); *F41A 21/325* (2013.01); *F41A 21/36* (2013.01)

(58) Field of Classification Search
CPC ..... F41A 21/34; F41A 21/325; F41A 21/36
USPC ..... 89/14.2
See application file for complete search history.

(56) References Cited

U.S. PATENT DOCUMENTS 10,845,150 B1 * 11/2020 Oglesby ..... F41A 21/34
11,150,045 B1 * 10/2021 Oglesby ..... F41A 21/30
11,221,189 B1 * 1/2022 Couvillion ..... F41A 21/30
11,248,870 B1 * 2/2022 Nagy-Zambo ..... F41A 21/30
2020/0224989 A1 * 7/2020 Bundy ..... F41A 21/325
2021/0003360 A1 * 1/2021 Kras ..... F41A 21/30
2021/0389075 A1 * 12/2021 Bray ..... F41A 21/36
2021/0389076 A1 * 12/2021 Turnblom ..... F41A 21/34
2021/0404760 A1 * 12/2021 Hipp ..... F41A 21/32

* cited by examiner

*Primary Examiner* — Samir Abdosh
(74) *Attorney, Agent, or Firm* — Shaddock Law Group, PC

(57) ABSTRACT

A muzzle device and blast sleeve system that includes a muzzle device having a muzzle device borehole, one or more venting apertures extending between the muzzle device borehole and an outer surface of the muzzle device, grouped venting apertures with at least one venting trough extending from or through each venting aperture to a muzzle device first end, and at least one screw recess; a blast sleeve having a blast sleeve borehole extending therethrough, wherein the blast sleeve borehole matingly corresponds to and allows for frictional engagement between the outer surface of the muzzle device and the inner blast sleeve sidewall of the blast sleeve borehole, and one or more venting ports formed through the blast sleeve to be aligned with at least two of the venting apertures; and an anti-rotation screw, positionable through the screw aperture and at least a portion of the screw recess.

20 Claims, 15 Drawing Sheets

MUZZLE DEVICE AND BLAST SLEEVE

CROSS-REFERENCE TO RELATED APPLICATIONS

This patent application claims the benefit of U.S. Patent Application Ser. No. 63/005,595, filed Apr. 6, 2020, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE PRESENT DISCLOSURE

1. Field of the Present Disclosure

The present disclosure relates generally to the field of firearms. More specifically, the present disclosure relates to enhanced muzzle device and blast sleeves for firearms.

2. Description of Related Art

A muzzle brake is a device that is attached to the second end of a firearm muzzle, which redirects propellant gases to counter recoil and unwanted barrel rise that normally occurs during the firing sequence.

During normal operation of a firearm, and particularly a rifle, when a round is fired, expanding gasses from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel.

A flash suppressor, flash guard, flash eliminator, or flash hider is a device that is attached to the second end of a muzzle of a firearm that reduces the visible flash signature of the firearm, when it is fired, by dispersing or cooling the burning propellant gases, as they exit the muzzle of the firearm. The flash suppressor reduces the chances that the individual shooting the firearm will be temporarily blinded in lowlight shooting conditions and/or reduce the degree of muzzle flash visible to others.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

The typical flash suppressor geometry and arrangement has various shortcomings. For example, known flash suppressors do not allow for sufficient propellant gas to be cooled or disbursed prior to exiting the muzzle end of the firearm. Because of this, known flash suppressors do not produce an effective amount of muzzle flash reduction.

Additionally, a typical muzzle device is either a flash suppressor or a muzzle brake, with no option for converting between a flash suppressor and a muzzle brake.

Thus, the features and elements of the presently disclosed muzzle device and blast sleeve provide various muzzle device features and design elements that overcome the shortcomings of known muzzle devices and provide improved blast mitigation, flash suppression, and optional muzzle brake features.

In various exemplary, nonlimiting embodiments, the muzzle device and blast sleeve of the present disclosure includes at least some of a main body or muzzle device, an outer blast sleeve, and an anti-rotation screw.

The muzzle device has a standard mounting provision for AR style barrel. In various exemplary embodiments, there is a tight bore diameter running thru the forward section of the muzzle device, which has substantially perpendicular, vertical intersecting venting apertures that come to the outer diameter spaced in intervals and pattern radially around the borehole. Parallel to the main tight borehole, positioned at different diametral heights are venting recesses that pattern radially to intersect the previously mentioned vertical venting apertures and vent to and impose against the inner diameter of the blast sleeve.

In certain exemplary embodiments, each of the vertical venting apertures and horizontal venting recesses are at least partially internally threaded to aid in gas disruption and flame dispersion. At the outer diameter of the muzzle device, positioned at equal and radial intervals, are widened troughs/slots that act as a vertical surface to give a "brake" type action for the gas to impose against. This is all contained within the blast sleeve. When positioned around the muzzle device, the blast sleeve vents propellant gases forward, between an inner surface of the blast sleeve and the venting troughs, parallel to the main bore.

In various exemplary embodiments, two venting ports are formed through the blast sleeve. When the blast sleeve is aligned with the muzzle device, the venting ports are aligned with corresponding venting apertures and optionally venting recesses to give a vertical muzzle rise mitigation factor.

In various exemplary embodiments, the blast sleeve is tight-tolerance, press fit onto the muzzle device. This is a friction fit system.

Optionally, a screw aperture is formed at a 6 o'clock or other position through the blast sleeve, so as to be aligned with an at least partially internally threaded screw recess in the muzzle device. In this manner, an anti-rotation screw can be positioned between the aligned screw aperture and screw recess to resist rotation of the blast sleeve relative to the muzzle device. This may also aid in removal of linear movement of the blast sleeve relative to the muzzle device, particularly due to effects of thermal growth.

The present disclosure is directed to a muzzle device and blast sleeve comprising a muzzle device formed of a portion of substantially cylindrical material that defines a muzzle device body having an attachment portion and a suppressor portion, wherein a muzzle device borehole is formed through the muzzle device, wherein one or more venting apertures extend between the muzzle device borehole and an outer surface of the muzzle device so as to allow fluid communication between the muzzle device borehole and an exterior of the muzzle device, wherein a series of grouped venting apertures are positioned along the suppressor portion of the muzzle device at spaced apart locations and wherein each series of grouped venting apertures is positioned radially or angularly from each subsequent series of grouped venting apertures, wherein at least one venting trough is formed so as to extend from or through each venting aperture to the muzzle device first end of the muzzle device, wherein a venting recess is formed around at least a portion of each venting aperture, and wherein at least one at least partially internally threaded screw recess extends into at least a portion of the muzzle device body; a blast sleeve formed of a substantially cylindrical material that defines an outer blast sleeve sidewall, wherein a blast sleeve borehole extends through the blast sleeve and is defined by an inner blast sleeve sidewall, wherein the blast sleeve borehole has an inner diameter and shape, which matingly corresponds to and allows for frictional engagement between at least a portion of the outer surface of the muzzle device and at least a portion of the inner blast sleeve sidewall if the muzzle device is at least partially positioned within the blast sleeve borehole, wherein a screw aperture is formed at a 6 o'clock or other position through the blast sleeve, and wherein one or more venting ports are formed through the blast sleeve body so as to allow fluid communication between the blast sleeve borehole and the outer blast sleeve sidewall, such that if the blast sleeve is appropriately positioned relative to the muzzle device, the venting ports are appropriately aligned with at least two venting apertures; and an anti-rotation screw, wherein if the blast sleeve is appropriately positioned relative to the muzzle device, the screw aperture is aligned with the screw recess and the anti-rotation screw can be positioned through the screw aperture and threadedly received within at least a portion of the screw recess.

In various exemplary, nonlimiting embodiments, an outer diameter of the attachment portion is less than an outer diameter of the suppressor portion.

In various exemplary, nonlimiting embodiments, an outer diameter of the attachment portion is substantially similar to or greater than the outer diameter of the suppressor portion.

In various exemplary, nonlimiting embodiments, the venting apertures extend radially from the muzzle device borehole and are formed at an acute angle relative to one another.

In various exemplary, nonlimiting embodiments, each of the grouped venting apertures in the series of grouped venting apertures is equally spaced from each other series of grouped venting apertures, along a longitudinal axis of the suppressor portion of the muzzle device.

In various exemplary, nonlimiting embodiments, sidewalls of each venting aperture are substantially smooth.

In various exemplary, nonlimiting embodiments, sidewalls of each venting aperture our at least partially internally threaded.

In various exemplary, nonlimiting embodiments, each venting trough extends from the outer surface of the muzzle device, toward the muzzle device borehole.

In various exemplary, nonlimiting embodiments, each venting trough extends substantially parallel to a longitudinal axis of the muzzle device.

In various exemplary, nonlimiting embodiments, at least one venting trough intersects or extends between aligned venting apertures.

In various exemplary, nonlimiting embodiments, at least two of the venting troughs our formed at different diametral heights or depths from the outer surface of the muzzle device.

In various exemplary, nonlimiting embodiments, the venting troughs are formed so as to extend from equally spaced apart locations around an outer perimeter of the muzzle device and so as to extend radially inward from the outer surface of the muzzle device toward the muzzle device borehole.

In various exemplary, nonlimiting embodiments, each venting recess comprises an elongate, substantially cylindrical, or oblong shape recess, extending substantially perpendicular to a longitudinal axis of the muzzle device.

In various exemplary, nonlimiting embodiments, sidewalls of each venting recess and/or venting trough are substantially smooth.

In various exemplary, nonlimiting embodiments, sidewalls of each venting recess and/or venting trough are at least partially internally threaded.

In various exemplary, nonlimiting embodiments, the screw recess is formed at a 6 o'clock position of the muzzle device body and wherein the screw aperture is formed at a 6 o'clock position of the blast sleeve.

In various exemplary, nonlimiting embodiments, the venting ports have a substantially cylindrical or oblong shape.

In various exemplary, nonlimiting embodiments, if the blast sleeve is appropriately secured to the muzzle device, the venting ports are appropriately aligned with venting apertures so as to allow fluid communication between the muzzle device borehole, via the aligned venting ports and the venting apertures, to the exterior of the blast sleeve.

In various exemplary embodiments, the present disclosure is directed to a muzzle device and blast sleeve comprising a muzzle device having an attachment portion and a suppressor portion, wherein a muzzle device borehole is formed through the muzzle device, wherein one or more venting apertures extend between the muzzle device borehole and an outer surface of the muzzle device so as to allow fluid communication between the muzzle device borehole and an exterior of the muzzle device, wherein a series of grouped venting apertures are positioned along the suppressor portion of the muzzle device at spaced apart locations and wherein each series of grouped venting apertures is positioned radially or angularly from each subsequent series of grouped venting apertures, wherein at least one venting trough is formed so as to extend, substantially parallel to a longitudinal axis of the muzzle device borehole, from or through each venting aperture to the muzzle device first end of the muzzle device, wherein a venting recess is formed around at least a portion of each venting aperture, and wherein at least one at least partially internally threaded screw recess extends into at least a portion of the muzzle device; a substantially cylindrical blast sleeve, wherein a blast sleeve borehole extends through the blast sleeve and is defined by an inner blast sleeve sidewall, wherein the blast sleeve borehole has an inner diameter and shape, which matingly corresponds to and allows for frictional engagement between at least a portion of the outer surface of the muzzle device and at least a portion of the inner blast sleeve sidewall if the muzzle device is at least partially positioned within the blast sleeve borehole, wherein a screw aperture is formed through the blast sleeve, and wherein one or more venting ports are formed through the blast sleeve so as to allow fluid communication between the blast sleeve borehole and an outer blast sleeve sidewall, such that if the blast sleeve is appropriately positioned relative to the muzzle device, the venting ports are aligned with at least two of the venting apertures; and an anti-rotation screw, wherein if the blast sleeve is appropriately positioned relative to the muzzle device, the screw aperture is aligned with the screw recess and the anti-rotation screw can be positioned through the screw aperture and threadedly received within at least a portion of the screw recess.

In various exemplary embodiments, the present disclosure is directed to a muzzle device and blast sleeve comprising a muzzle device having an attachment portion and a suppressor portion, wherein a muzzle device borehole is formed through the muzzle device, wherein one or more venting apertures extend between the muzzle device borehole and an outer surface of the muzzle device between the muzzle device borehole and an exterior of the muzzle device, wherein a series of grouped venting apertures are positioned along the suppressor portion of the muzzle device at spaced apart locations and wherein each series of grouped venting apertures is positioned radially or angularly from each subsequent series of grouped venting apertures, wherein at least one venting trough is formed so as to extend, substantially parallel to a longitudinal axis of the muzzle device borehole, from or through each venting aperture to the muzzle device first end of the muzzle device, and wherein a venting recess is formed around at least a portion of each venting aperture; and a substantially cylindrical blast sleeve, wherein a blast sleeve borehole extends through the blast sleeve and is defined by an inner blast sleeve sidewall, wherein the blast sleeve borehole has an inner diameter and shape, which allows for frictional engagement between at least a portion of the outer surface of the muzzle device and at least a portion of the inner blast sleeve sidewall if the muzzle device is at least partially positioned within the blast sleeve borehole, and wherein one or more venting ports are formed through the blast sleeve between the blast sleeve borehole and an outer blast sleeve sidewall, such that if the blast sleeve is appropriately positioned relative to the muzzle device, the venting ports are aligned with at least two of the venting apertures.

Accordingly, the present disclosure provides a muzzle device and blast sleeve with improved muzzle flash suppression.

The present disclosure separately provides a muzzle device and blast sleeve that provides improved muzzle rise suppression.

The present disclosure separately provides a muzzle device and blast sleeve that provides improved cooling, burning, and/or disbursement of propelling gases exiting the muzzle end of a firearm.

The present disclosure separately provides a muzzle device and blast sleeve that can be retrofitted to an existing flash suppressor or other muzzle device.

The present disclosure separately provides a muzzle device and blast sleeve that can be easily installed by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the present disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed embodiments of the present disclosure are provided herein. However, it is to be understood that the disclosed embodiments are merely exemplary of the present invention that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

For simplicity and clarification, the design factors and operating principles of the muzzle device and blast sleeve according to the present disclosure are explained with reference to various exemplary embodiments of a muzzle device and blast sleeve according to the present disclosure. The basic explanation of the design factors and operating principles of the muzzle device and blast sleeve is applicable for the understanding, design, and operation of the muzzle device and blast sleeve of the present disclosure. It should be appreciated that the muzzle device and blast sleeve can be adapted to many applications where a muzzle device and blast sleeve can be used.

It should also be appreciated that the terms "firearm", "muzzle device and blast sleeve", and "blast shield" are used for basic explanation and understanding of the operation of the systems, methods, and apparatuses of the present disclosure. Therefore, the terms "firearm", "muzzle device and blast sleeve", and "blast shield" are not to be construed as limiting the systems, methods, and apparatuses of the present disclosure.

For simplicity and clarification, the various embodiments of the muzzle device and blast sleeves of the present disclosure will be described as being used in connection with a rifle barrel. However, it should be appreciated that these are merely exemplary embodiments of the muzzle device and blast sleeves and are not to be construed as limiting this invention. Thus, the muzzle device and blast sleeves of the present disclosure may be utilized in connection with any rifle, pistol, artillery piece, firearm, or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 1:
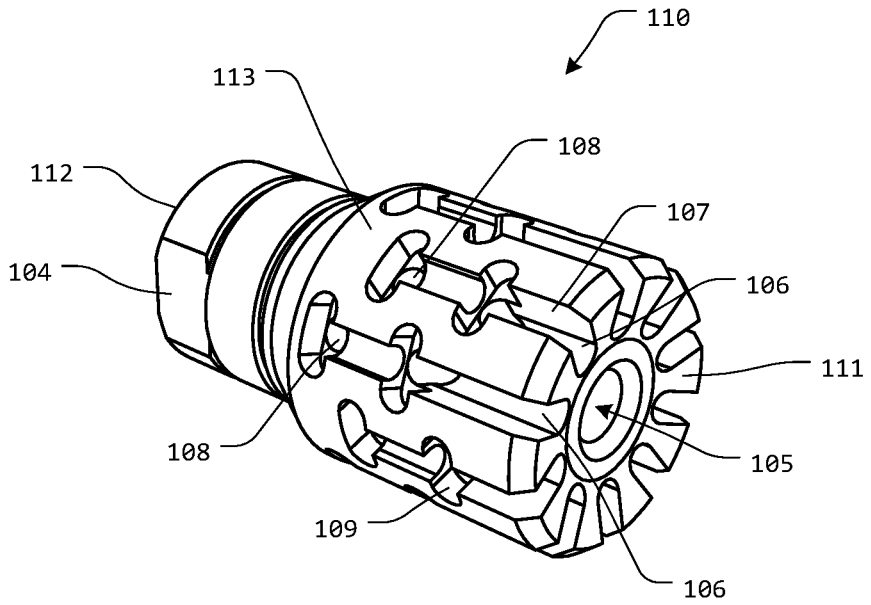
FIG. 1 shows an upper front perspective view of an exemplary embodiment of a muzzle device, according to the present disclosure.
Figure 2:
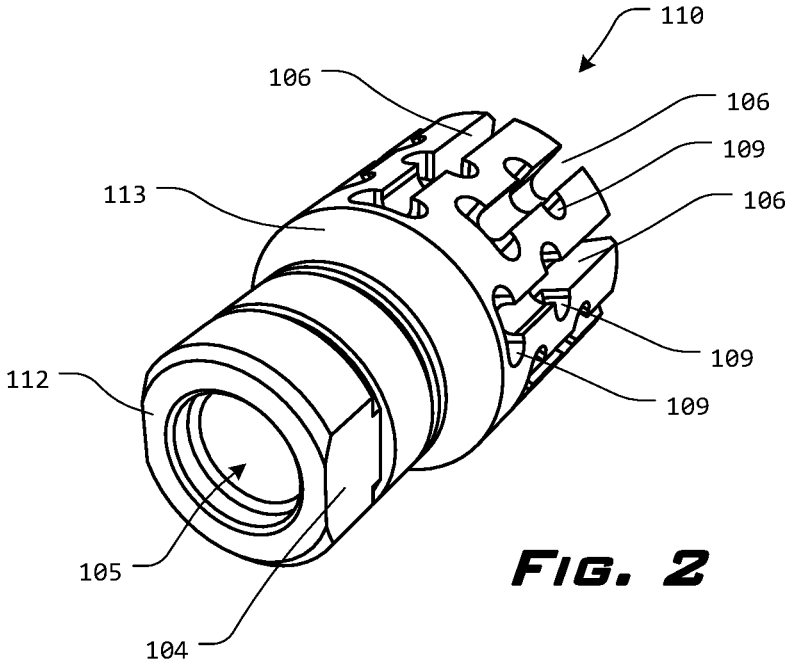
FIG. 2 shows an upper rear perspective view of an exemplary embodiment of a muzzle device, according to the present disclosure.
Figure 3:
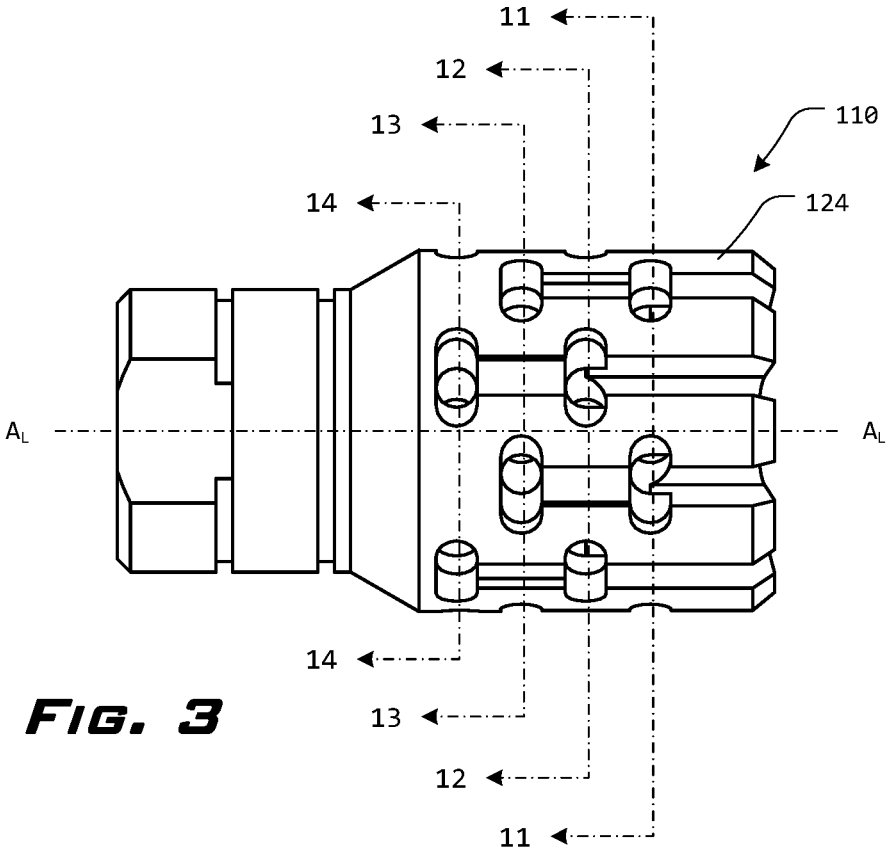
FIG. 3 shows a right side view of an exemplary embodiment of a muzzle device, according to the present disclosure.
Figure 4:
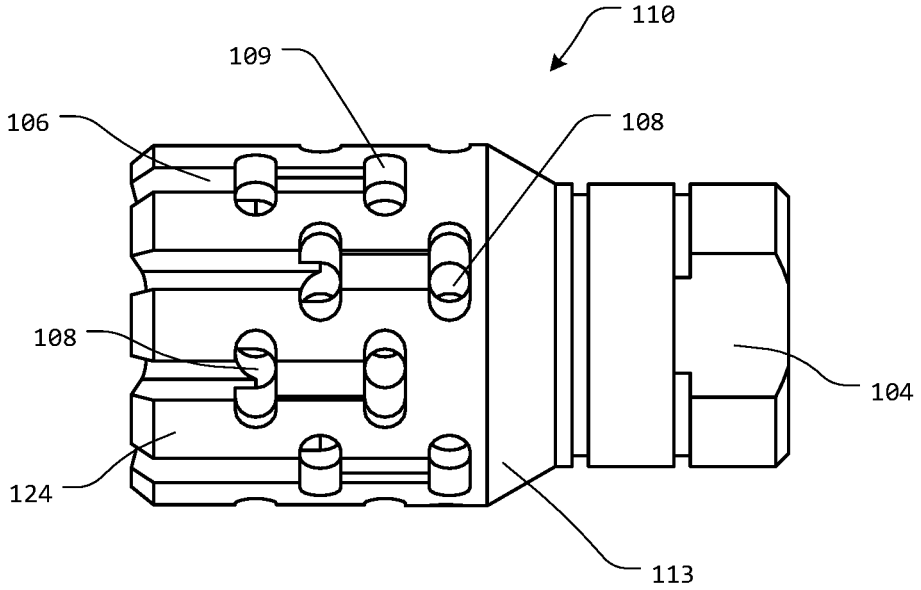
FIG. 4 shows a left side view of an exemplary embodiment of a muzzle device, according to the present disclosure.
Figure 5:
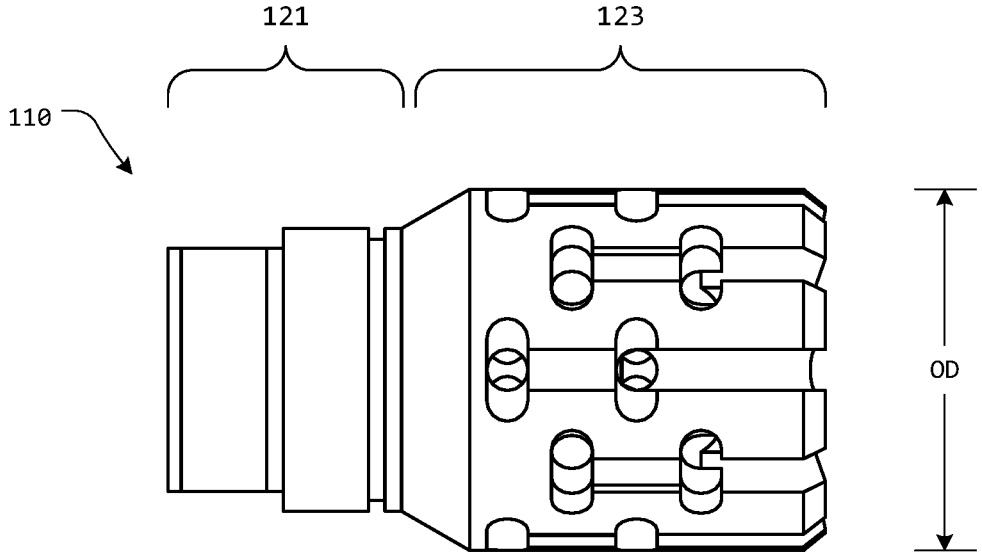
FIG. 5 shows a top view of an exemplary embodiment of a muzzle device, according to the present disclosure.
Figure 6:
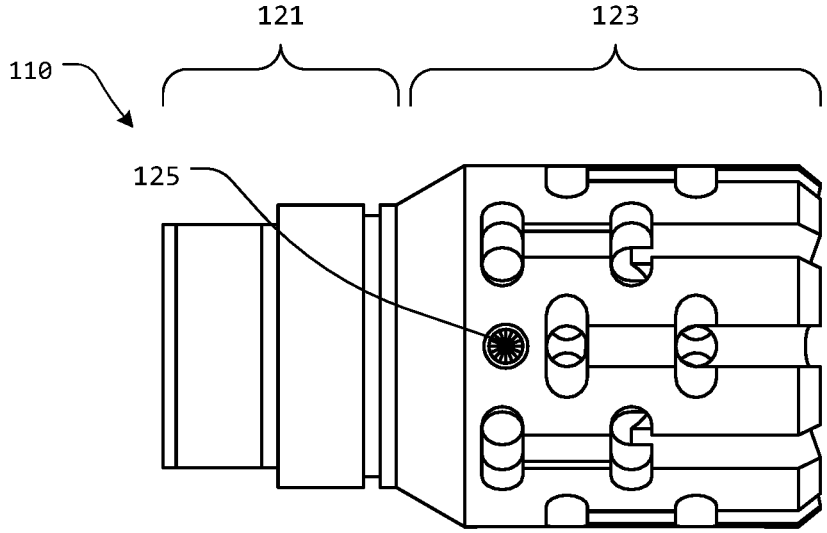
FIG. 6 shows a bottom view of an exemplary embodiment of a muzzle device, according to the present disclosure.
Figure 7:
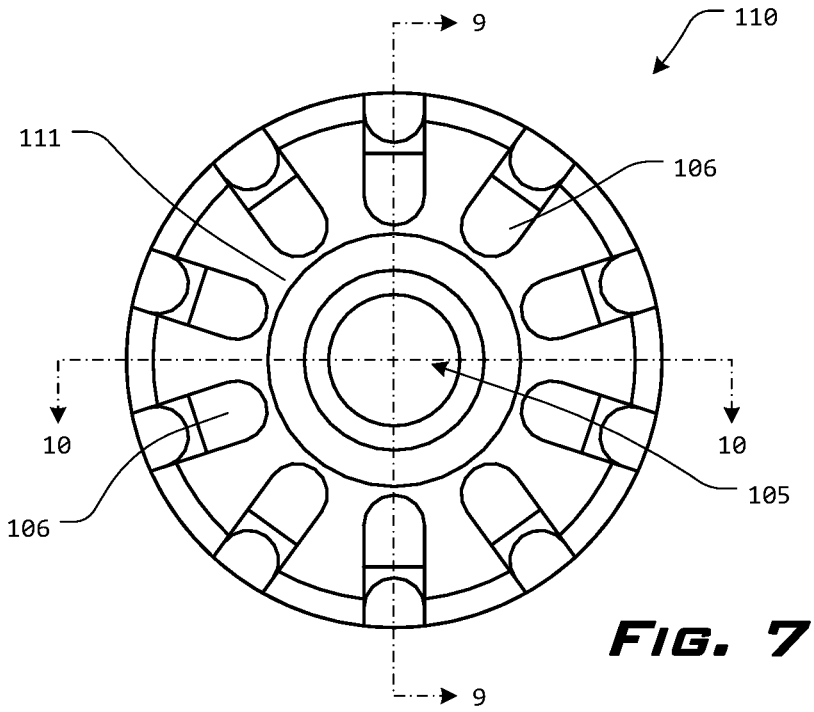
FIG. 7 shows a front view of an exemplary embodiment of a muzzle device, according to the present disclosure.
Figure 8:
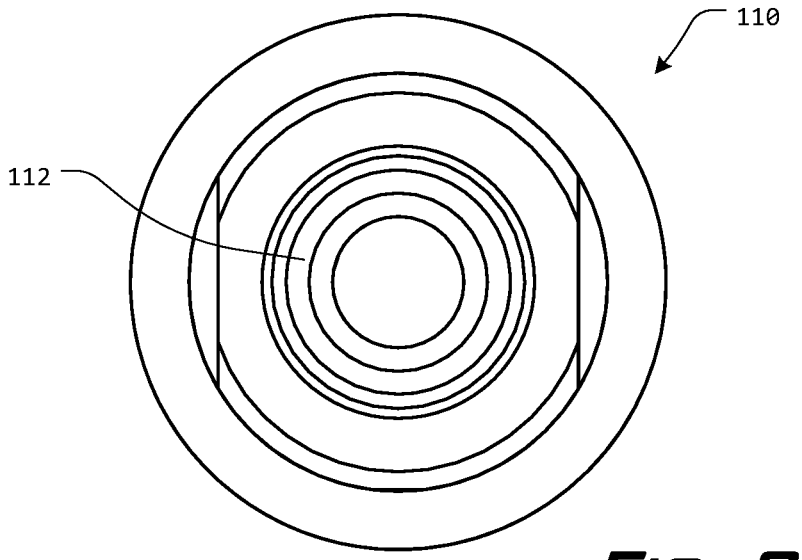
FIG. 8 shows a rear view of an exemplary embodiment of a muzzle device, according to the present disclosure.
Figure 9:
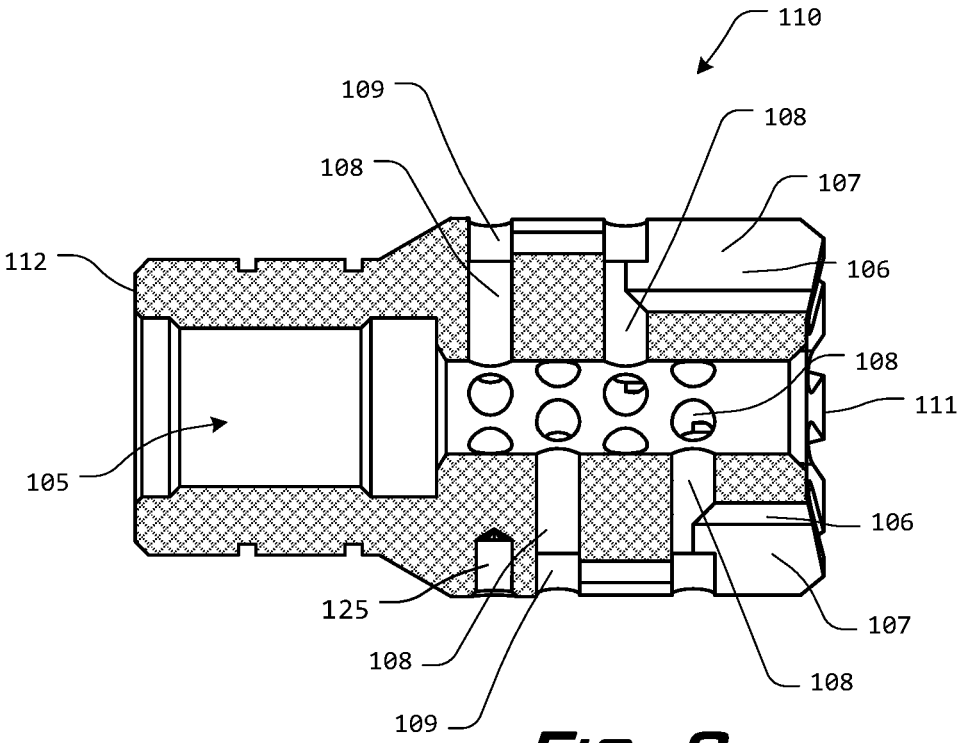
FIG. 9 shows cross-sectional view taken along line 9-9 of the muzzle device of FIG. 7, according to the present disclosure.
Figure 10:
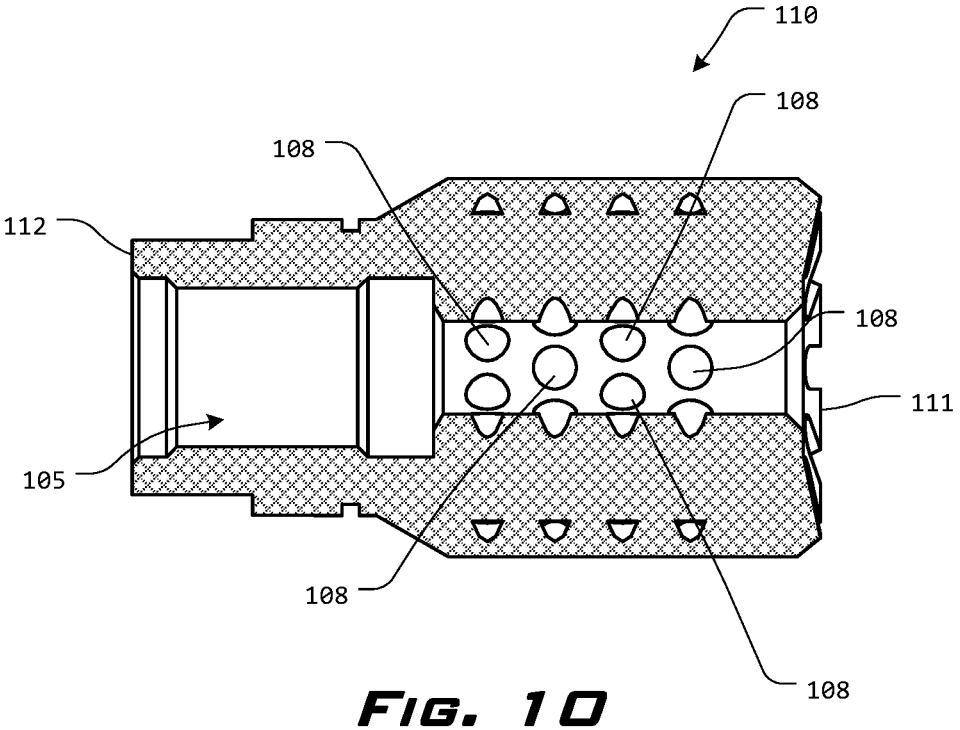
FIG. 10 shows cross-sectional view taken along line 10-10 of the muzzle device of FIG. 7, according to the present disclosure.
Figure 11:
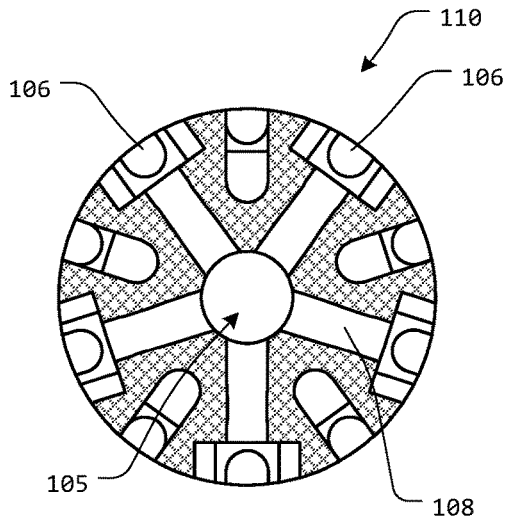
FIG. 11 shows cross-sectional view taken along line 11-11 of the muzzle device of FIG. 3, according to the present disclosure.
Figure 12:
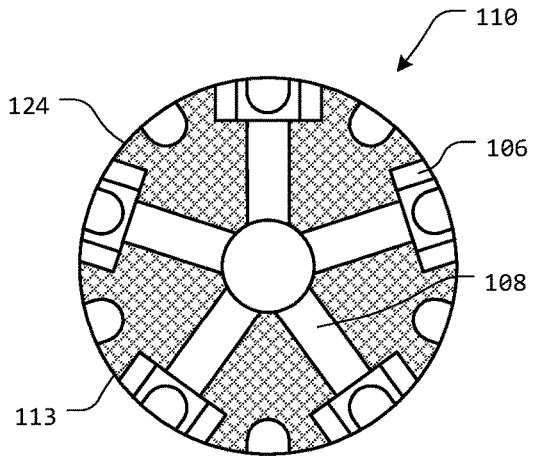
FIG. 12 shows cross-sectional view taken along line 12-12 of the muzzle device of FIG. 3, according to the present disclosure.
Figure 13:
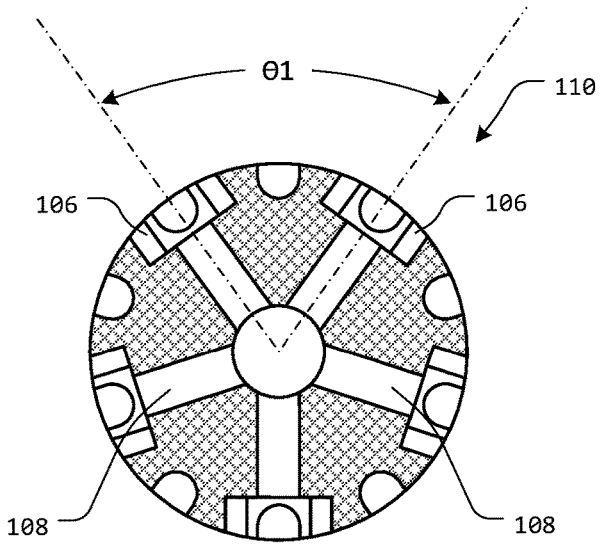
FIG. 13 shows cross-sectional view taken along line 13-13 of the muzzle device of FIG. 3, according to the present disclosure.
Figure 14:
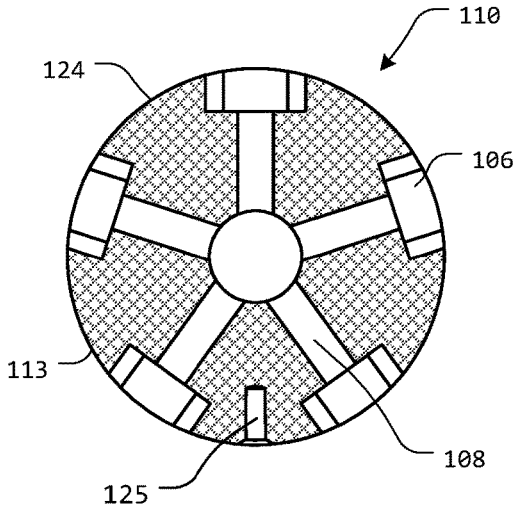
FIG. 14 shows cross-sectional view taken along line 14-14 of the muzzle device of FIG. 3, according to the present disclosure.
Figure 15:
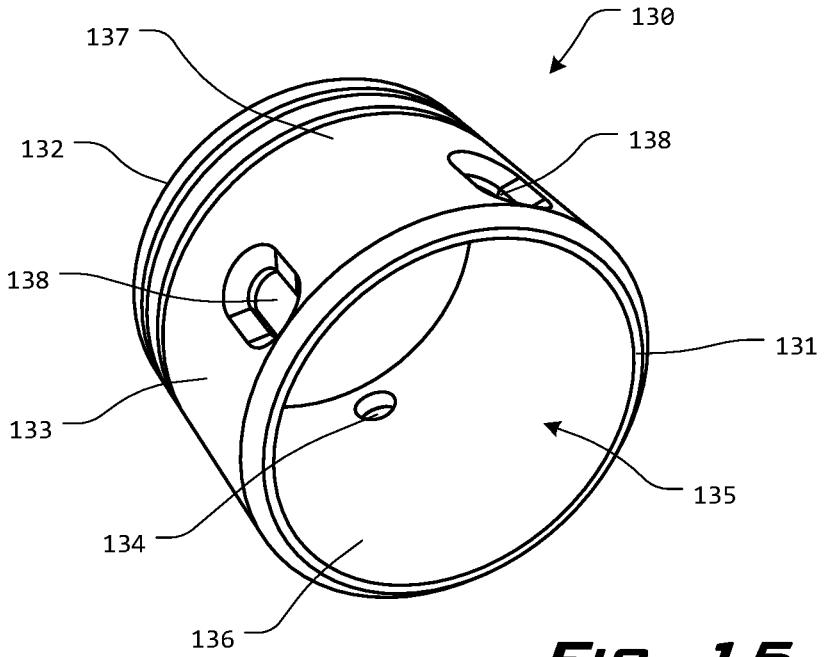
FIG. 15 shows an upper, front, perspective view of an exemplary embodiment of a blast sleeve, according to the present disclosure.
Figure 16:
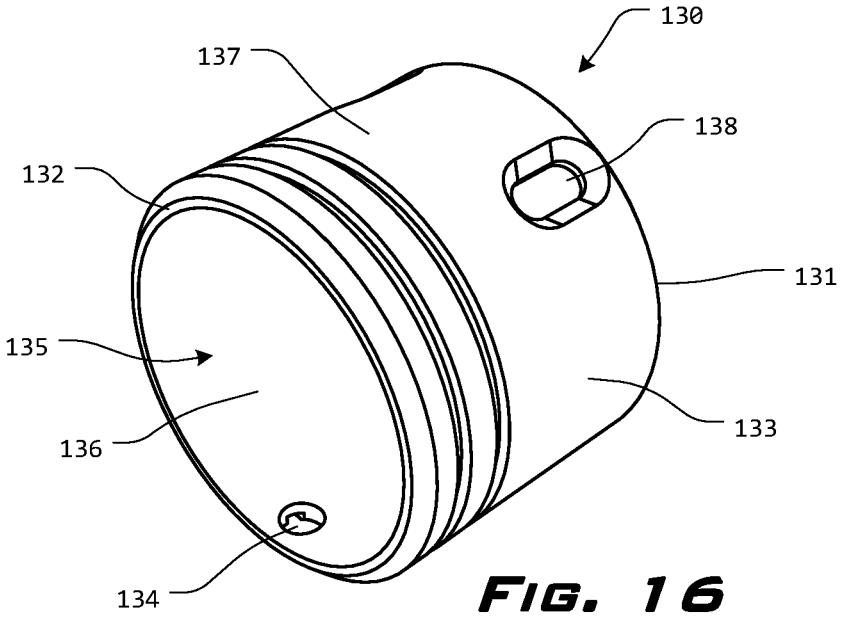
FIG. 16 shows an upper, rear, perspective view of an exemplary embodiment of a blast sleeve, according to the present disclosure.
Figure 17:
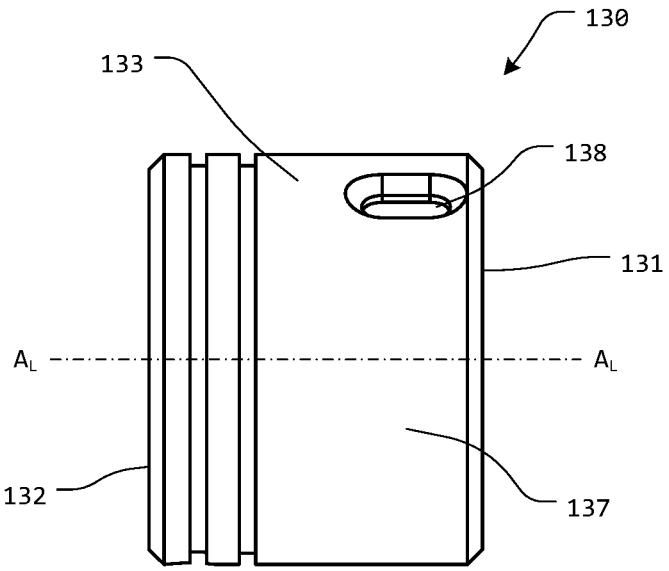
FIG. 17 shows a right side view of an exemplary embodiment of a blast sleeve, according to the present disclosure.
Figure 18:
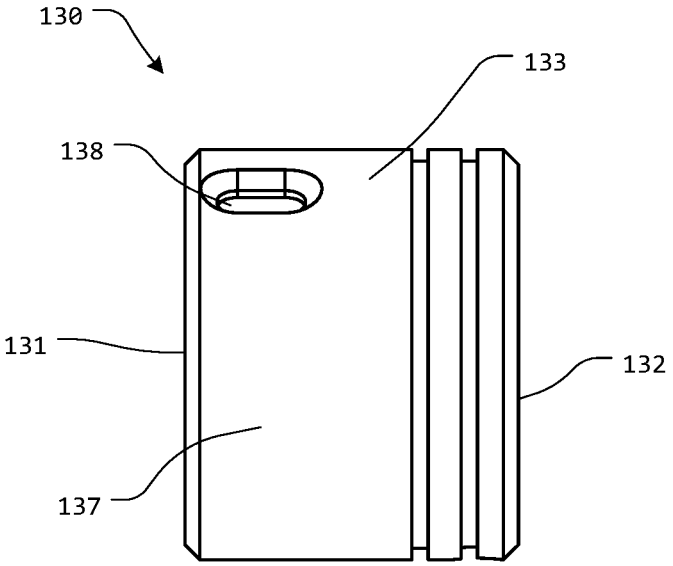
FIG. 18 shows a left side view of an exemplary embodiment of a blast sleeve, according to the present disclosure.
Figure 19:
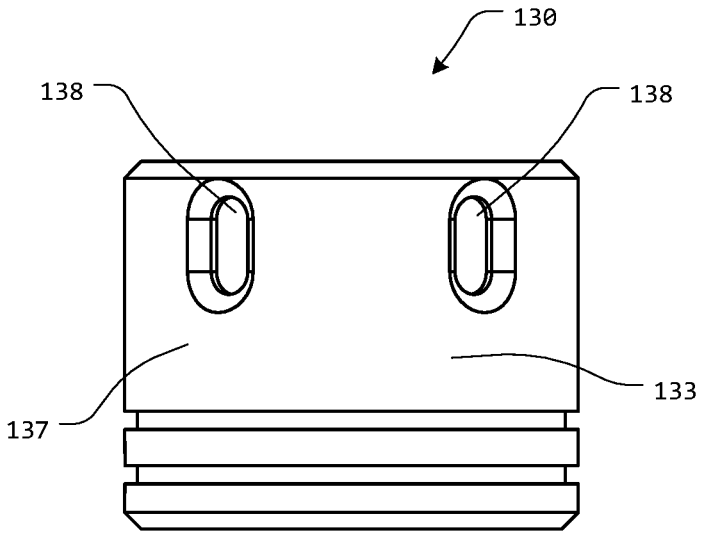
FIG. 19 shows a top view of an exemplary embodiment of a blast sleeve, according to the present disclosure.
Figure 20:
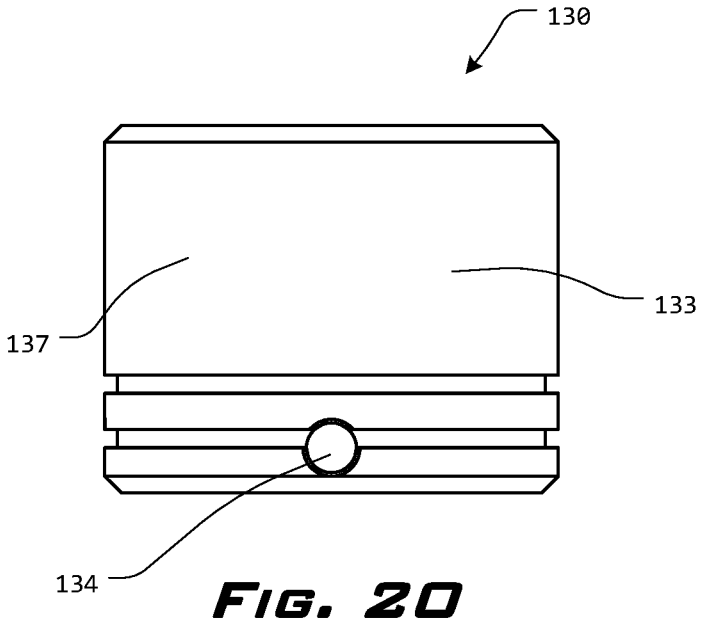
FIG. 20 shows a bottom view of an exemplary embodiment of a blast sleeve, according to the present disclosure.
Figure 21:
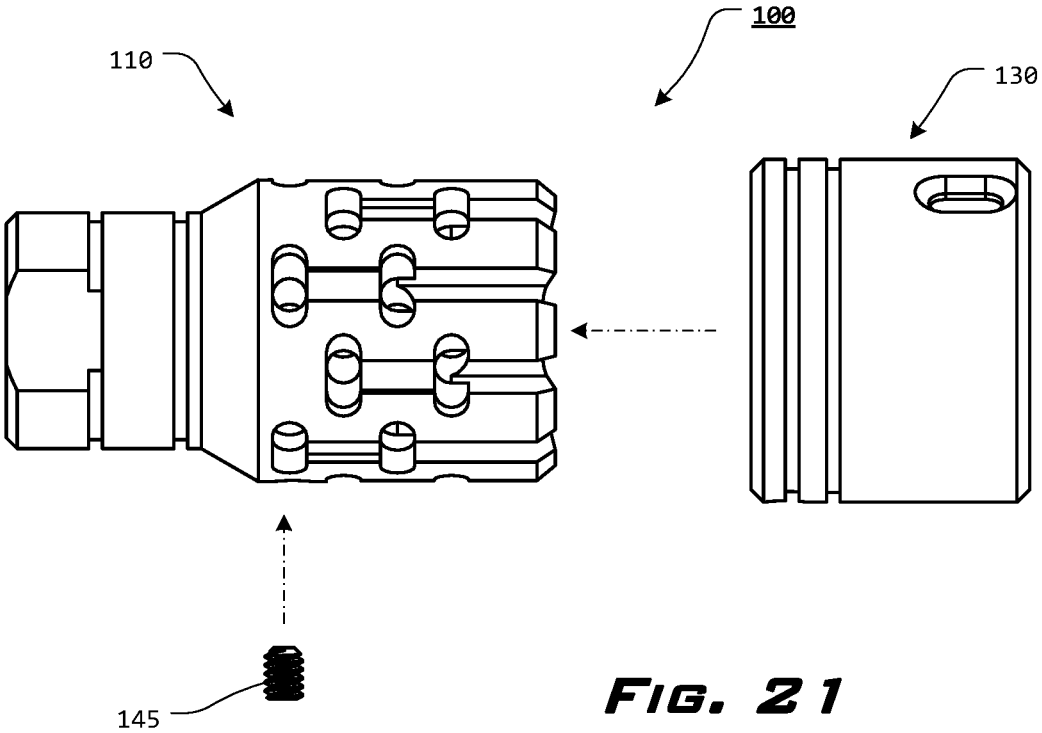
FIG. 21 a right side view, illustrating exemplary alignment of certain components of the exemplary embodiment of the muzzle device and blast sleeve, according to the present disclosure.
Figure 22:
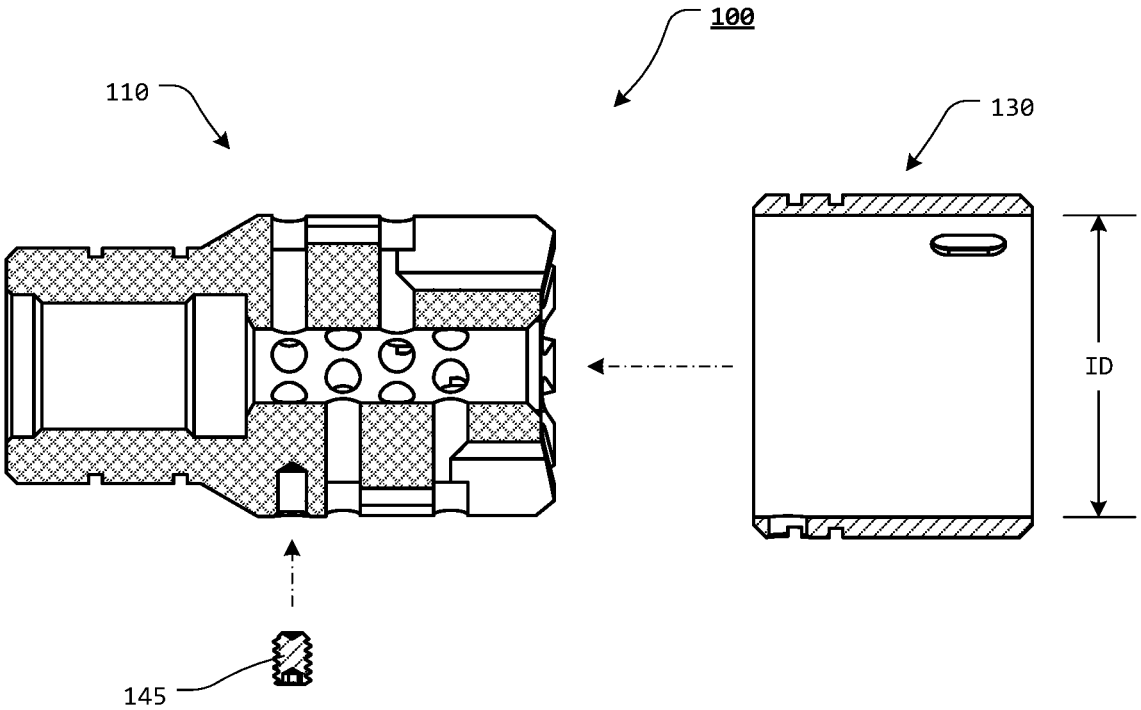
FIG. 22 a right side, cross-sectional view, illustrating exemplary alignment of certain components of the exemplary embodiment of the muzzle device and blast sleeve, according to the present disclosure.
Figure 23:
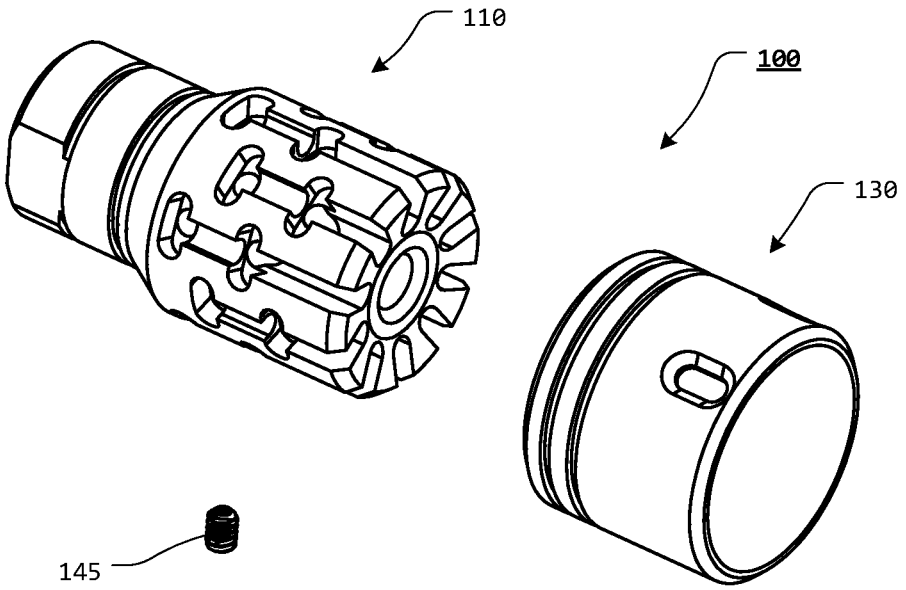
FIG. 23 an upper, right, perspective view, illustrating exemplary alignment of certain components of the exemplary embodiment of the muzzle device and blast sleeve, according to the present disclosure.
Figure 24:
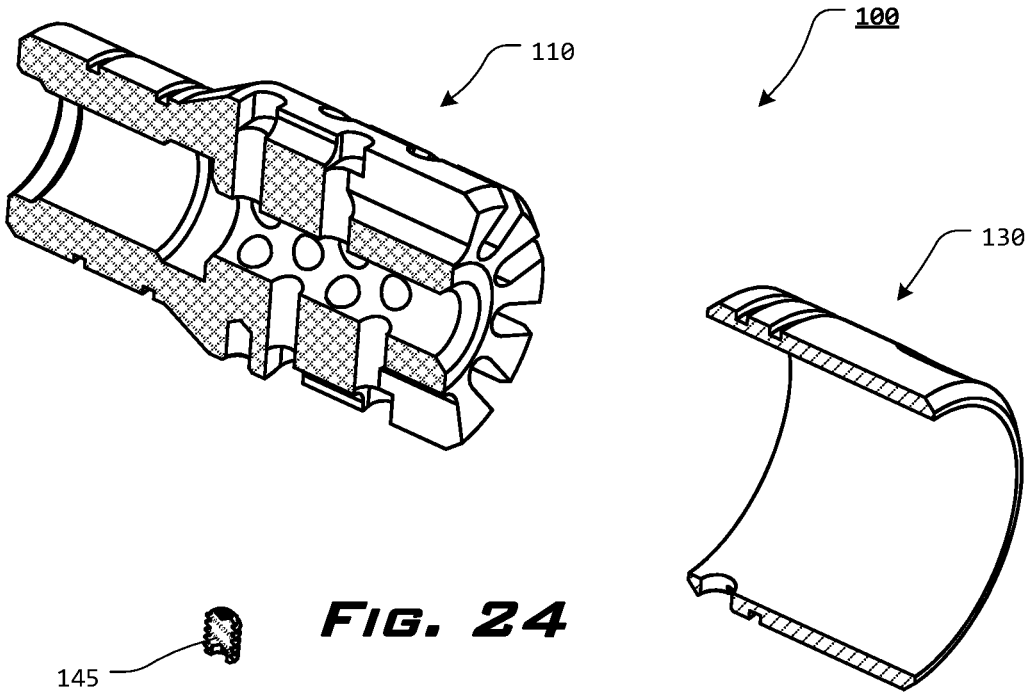
FIG. 24 an upper, right, perspective, cross-sectional view, illustrating exemplary alignment of certain components of the exemplary embodiment of the muzzle device and blast sleeve, according to the present disclosure.
Figure 25:
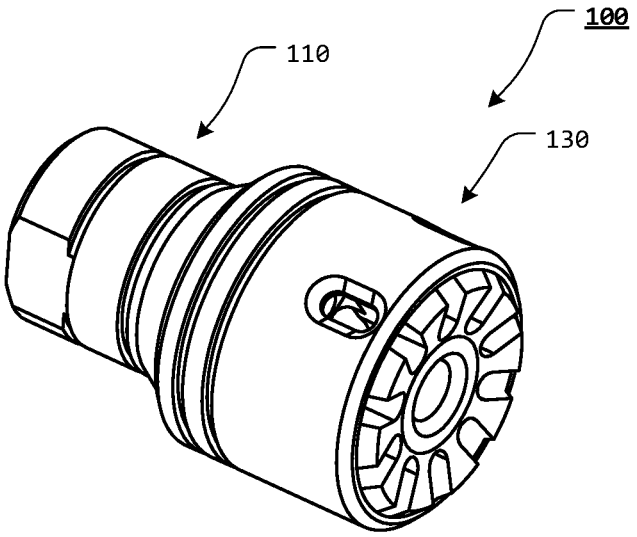
FIG. 25 an upper, right, perspective view, illustrating exemplary alignment of certain components of the exemplary embodiment of the muzzle device and blast sleeve, according to the present disclosure.
Figure 26:
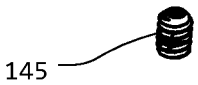
FIG. 26 an upper, right, perspective, cross-sectional view, illustrating exemplary alignment of certain components of the exemplary embodiment of the muzzle device and blast sleeve, according to the present disclosure.
Figure 26:
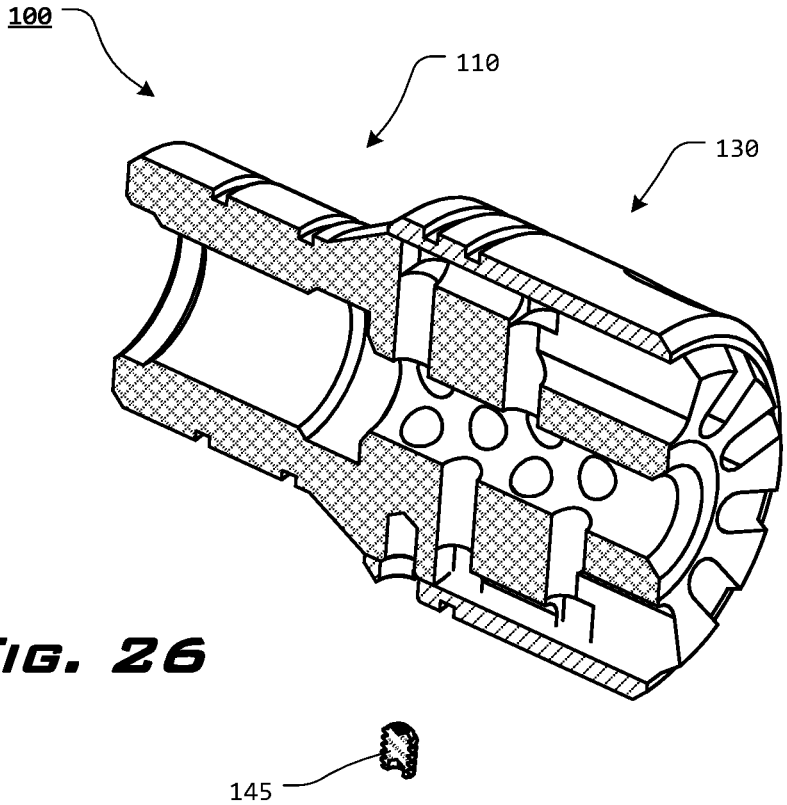
Figure 27:
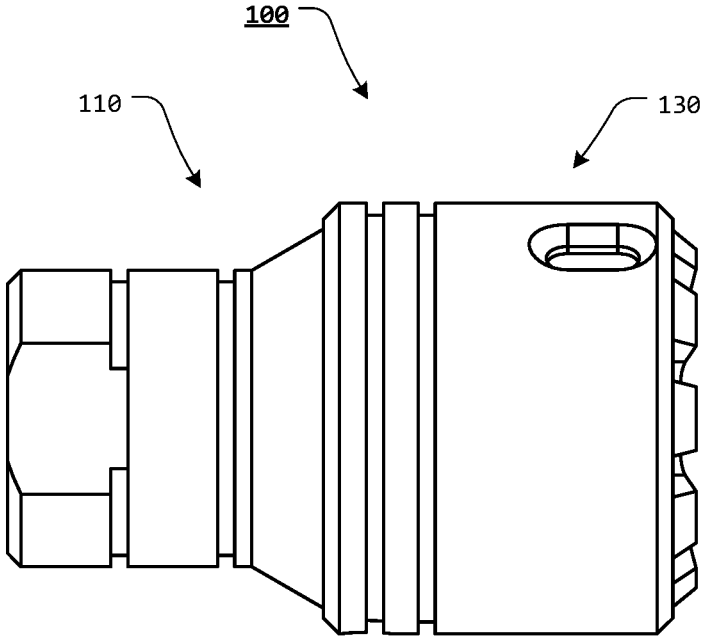
FIG. 27 a right, side view, illustrating exemplary alignment of certain components of the exemplary embodiment of the muzzle device and blast sleeve, according to the present disclosure.
Figure 28:
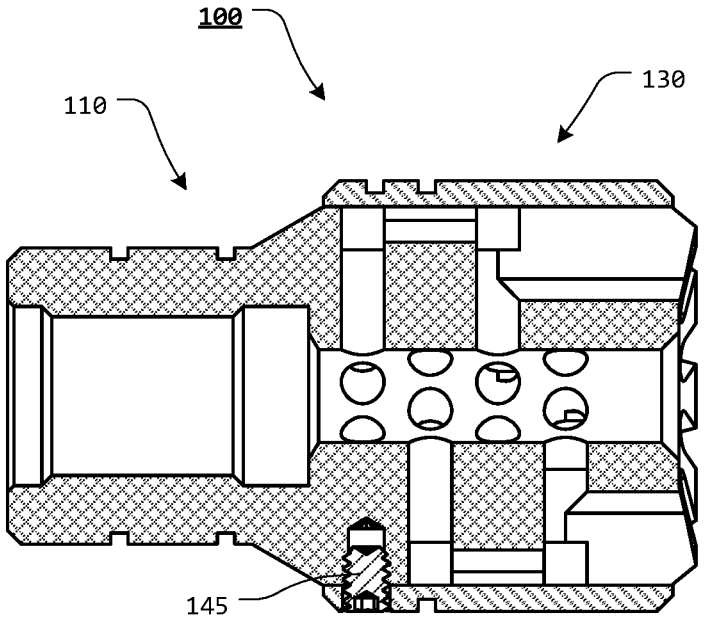
FIG. 28 a right, side, cross-sectional view, illustrating exemplary alignment of certain components of the exemplary embodiment of the muzzle device and blast sleeve, according to the present disclosure.
Figure 29:
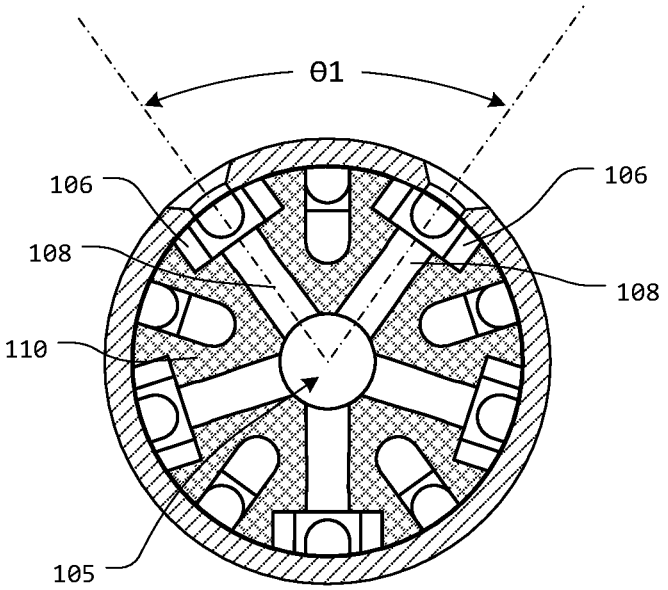
FIG. 29 a front view, illustrating exemplary alignment of certain components of the exemplary embodiment of the muzzle device and blast sleeve, according to the present disclosure.
Figure 30:
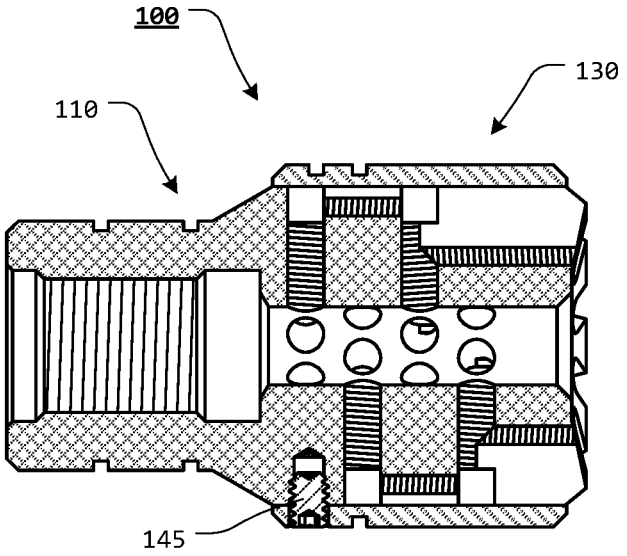
FIG. 30 a right, side, cross-sectional view, illustrating exemplary alignment of certain components of the exemplary embodiment of the muzzle device and blast sleeve, according to the present disclosure.
Figure 31:
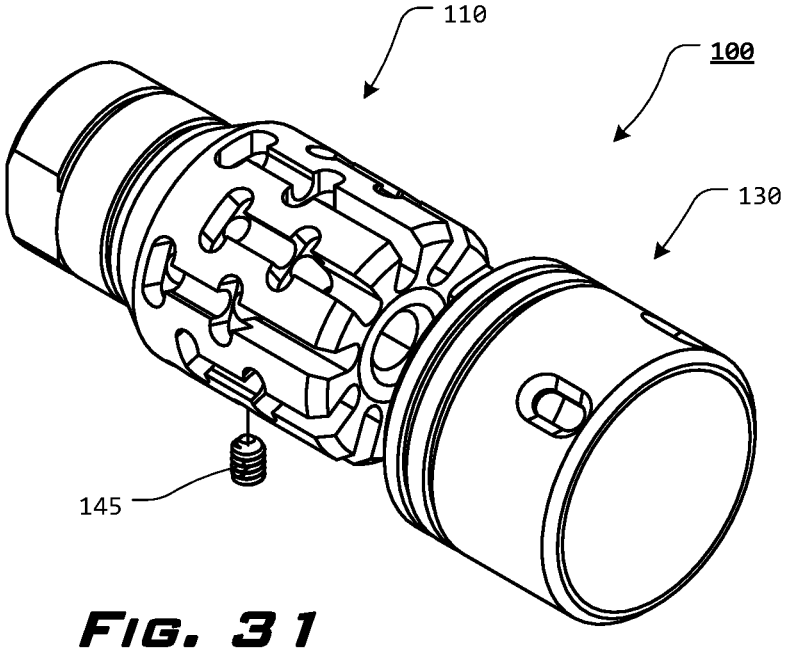
FIG. 31 an upper, right, front perspective view, illustrating exemplary alignment of certain components of the exemplary embodiment of the muzzle device and blast sleeve, according to the present disclosure.
Figure 32:
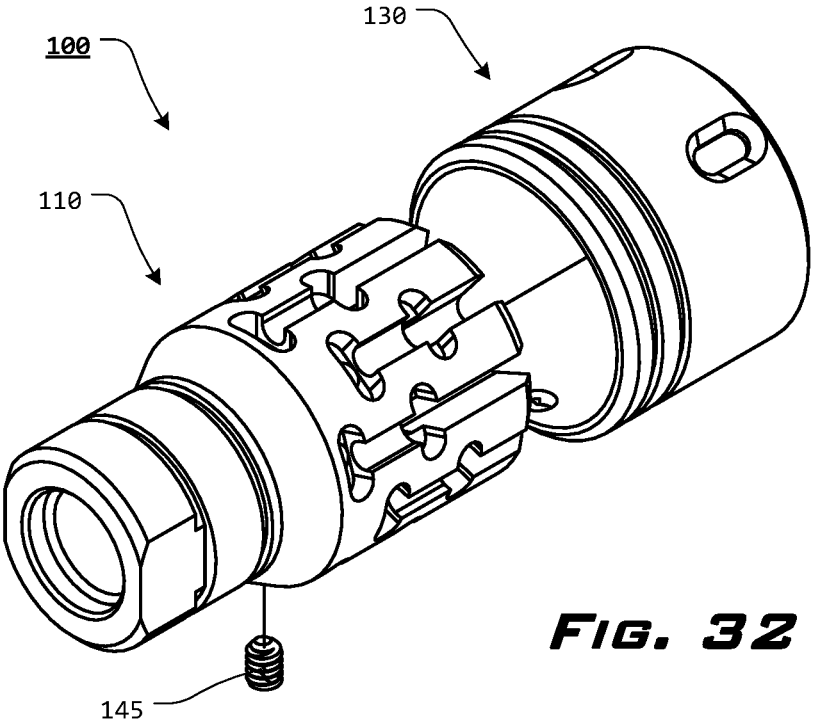
FIG. 32 an upper, right, rear perspective view, illustrating exemplary alignment of certain components of the exemplary embodiment of the muzzle device and blast sleeve, according to the present disclosure.

Turning now to the drawing FIGS., FIGS. 1-32 illustrate certain elements and/or aspects of an exemplary embodiment of a muzzle device system 100 comprising a muzzle device 110 and blast sleeve 130, according to the present disclosure. In certain illustrative, non-limiting embodiments of the present disclosure, as illustrated in FIGS. 1-32, the muzzle device 110 and blast sleeve 130 comprises at least some of a muzzle device 110, a blast sleeve 130, and an anti-rotation screw 145.

FIGS. 1-14 illustrate an exemplary embodiment of a muzzle device 110 that may optionally be used in connection with the currently disclosed muzzle device 110 and blast shield. The illustrated muzzle device 110 comprises an elongate portion of substantially cylindrical material that forms a muzzle device body 113, which extends along a longitudinal axis $A_L$ from a muzzle device first end 111 to a muzzle device second end 112. The muzzle device body 113 comprises an attachment portion 121 and a suppressor portion 123. A muzzle device borehole 105 is formed through the muzzle device 110, substantially along the longitudinal axis, $A_L$, of the muzzle device 110.

In various exemplary embodiments, an outer diameter of the attachment portion 121 is less than an outer diameter of the suppressor portion 123. Alternatively, the outer diameter of the attachment portion 121 may be substantially similar to or greater than the outer diameter of the suppressor portion 123.

An initial portion of the muzzle device borehole 105, extending from the muzzle device second end 112, includes an internally threaded portion. The internally threaded portion of the mobile device borehole is formed so as to generally interact with external threads of a barrel for attachment of the muzzle device 110 to a firearm barrel. In various exemplary embodiments, the muzzle device 110 has a standard mounting provision for AR style barrel.

To aid in the installation of the muzzle device 110, adapter flats 104 may optionally be formed of opposing parallel surfaces in various locations around the muzzle device 110, generally within the attachment portion 121. The flats 104, if included, provide parallel surfaces for a wrench or other installation device to grip the muzzle device 110.

One or more venting apertures 108 extend between the muzzle device borehole 105 in the outer surface 124 of the muzzle device 110. The one or more venting apertures 108 are formed through the muzzle device body 113 so as to allow fluid communication between the muzzle device borehole 105 and an exterior of the muzzle device 110. Thus, the one or more venting apertures 108 allow fluid communication between the central muzzle device borehole 105 of the muzzle device 110 and the outside surface of the muzzle device 110.

In various exemplary embodiments, the venting apertures 108 extend radially from the muzzle device borehole 105 and are formed at an acute angle Θ1 relative to one another. In various exemplary embodiments, each of the venting apertures 108 is formed at an angle Θ1 of 72° relative to each other venting aperture 108. As illustrated, five equally spaced venting apertures 108 may extend radially from the muzzle device borehole 105 at a given distance from the muzzle device first and/or muzzle device second end 112. Additionally, a series of grouped venting apertures 108 may be positioned along the suppressor portion 123 of the muzzle device 110.

As illustrated, the muzzle device 110 may include a series of grouped venting apertures 108, each of the series of grouped venting apertures 108 comprises equally spaced venting apertures 108 extending radially from the muzzle device borehole 105. Each of the grouped venting apertures 108 in the series of grouped venting apertures 108 is equally spaced from each other series of grouped venting apertures 108, along the longitudinal axis $A_L$ of the suppressor portion 123 of the muzzle device 110. Additionally, each series of grouped venting apertures 108 may optionally be positioned radially or angularly from each subsequent series of grouped venting apertures 108.

As illustrated, the muzzle device 110 may optionally include a series of four grouped venting apertures 108, each of the series of four grouped venting apertures 108 comprises five equally spaced venting apertures 108 extending radially from the muzzle device borehole 105. Each of the grouped venting apertures 108 in the series of grouped venting apertures 108 is equally spaced from each other series of grouped venting apertures 108, along the muzzle device body 113. Additionally, each series of grouped venting apertures 108 is positioned radially or angularly approximately 36° from each subsequent series of grouped venting apertures 108.

Each of the venting apertures 108 comprises a substantially cylindrical aperture extending from the muzzle device borehole 105 toward or to an outer surface 124 of the muzzle device 110. In certain exemplary embodiments, the sidewalls of each venting aperture 108 are substantially smooth. Alternatively, the sidewalls of each venting aperture 108 may be at least partially internally threaded to aid in gas disruption and flame dispersion as propellant gases flow from the muzzle device borehole 105 through each venting aperture 108.

As illustrated, the venting apertures 108 have substantially parallel sidewalls and have a substantially cylindrical or oblong shape. Alternatively, one or more of the venting apertures 108 may be tapered or reversed tapered and may take on other shapes. Thus, it should be understood that the overall angle, diameter, size, shape, and sidewalls surface preparation of each venting aperture 108 is a design choice based upon the desired functionality (i.e. fluid capacity, fluid flow characteristics, etc.) of the muzzle device 110.

In various exemplary embodiments, there is a tight bore diameter running thru the forward section of the muzzle device 110, which includes the substantially perpendicular, vertical intersecting venting apertures 108 that extent to the outer diameter spaced in intervals and pattern radially around the borehole.

At least one venting trough 106 is formed so as to extend from each venting aperture 108 to the muzzle device first end 111 of the muzzle device 110. Each venting trough 106 extends from the outer surface 124 of the muzzle device 110, toward the muzzle device borehole 105. Each venting trough 106 extends substantially parallel to the longitudinal axis $A_L$ of the muzzle device 110.

If venting apertures 108 are aligned with one another substantially parallel to the longitudinal axis, $A_L$, of the muzzle device 110, a venting trough 106 may intersect and extend between aligned venting apertures 108 to the muzzle device first end 111, as the venting trough 106 extends to the muzzle device first end 111.

The venting troughs 106 may optionally be formed at different diametral heights or depths from the outer surface 124 of the muzzle device 110. Thus, for example, a depth of a venting trough 106 extending between an initial venting aperture 108 and a subsequent aligned venting aperture 108 may be at a first depth, while the portion of the venting trough 106 extending from the subsequent aligned venting aperture 108 to the muzzle device first end 111 may be at a second, greater depth.

In various exemplary embodiments, the venting troughs 106 are formed so as to extend from equally spaced apart locations around the outer perimeter of the muzzle device 110 and so as to extend radially inward from the outer surface 124 of the muzzle device 110 toward the muzzle device borehole 105.

A venting recess 109 may optionally be formed around at least a portion of each venting aperture 108. If included, each venting recess 109 extends from the outer surface 124 of the muzzle device 110, toward the muzzle device borehole 105. In various exemplary embodiments, each venting recess 109 comprises an elongate, substantially cylindrical, or oblong shape recess, extending substantially perpendicular to the longitudinal axis $A_L$ of the muzzle device 110 and substantially perpendicular to any venting trough 106 intersecting a given venting aperture 108. The length, width, and depth of each venting recess 109 from the outer surface 124 of the muzzle device 110 is a design choice.

In certain exemplary embodiments, the sidewalls of each venting recess 109 and/or venting trough 106 are substantially smooth. Alternatively, the sidewalls of each venting recess 109 and/or the venting trough sidewalls 107 of each venting trough 106 may be at least partially internally threaded to aid in gas disruption and flame dispersion as propellant gases flow from the muzzle device borehole 105 through each venting recess 109 and/or venting trough 106.

In various exemplary, nonlimiting embodiments, at least one screw recess 125 is formed so as to extend into at least a portion of the muzzle device body 113. The screw recess 125 is at least partially internally threaded and is optionally formed at a 6 o'clock or other position of the muzzle device body 113.

As illustrated most clearly in FIGS. 15-20, the blast sleeve 130 comprises an elongate portion of substantially cylindrical material, defining an outer blast sleeve sidewall 137. The blast sleeve 130 forms a blast sleeve body 133, which extends along a longitudinal axis $A_L$ from a blast sleeve first end 131 to a blast sleeve second end 132.

A blast sleeve borehole 135 extends through the blast sleeve 130, from the first blast sleeve end to the second blast sleeve end and is defined by an inner blast sleeve sidewall 136.

While the blast sleeve 130 is shown and described as having a substantially cylindrical outer shape, defined by the outer blast sleeve sidewall 137, and a substantially cylindrical borehole or blast sleeve borehole 135, defined by the inner blast sleeve sidewall 136, it is to be in understood that the blast sleeve 130 may comprise any outer or inner shape. Thus, while a substantially cylindrical shape of the outer blast sleeve sidewall 137 would allow for ease in manufacturing and would correspond to the shape of the muzzle device 110, the shape of the outer blast sleeve sidewall 137 of the blast sleeve 130 is not limited to being substantially cylindrical and, for example, may be substantially oval, oblong, triangular, square, rectangular hexagonal, octagonal, etc.

Likewise, while the blast sleeve 130 is shown and described as having a substantially cylindrical blast sleeve borehole 135, as defined by the inner blast sleeve sidewall 136, is to be understood that the blast sleeve 130 may comprise any inner or blast sleeve borehole 135 shape. The size and shape of the blast sleeve borehole 135 is dictated by the shape of the outer surface 124 of the suppressor portion 123 of the muzzle device 110. The blast sleeve borehole 135 has an inner diameter (and shape), which matingly corresponds to and allows at least a portion of a muzzle device 110 to be at least partially positioned within the blast sleeve borehole 135, as illustrated most clearly in FIGS. 25-30. Thus, it should be appreciated that the size and shape of the blast sleeve borehole 135 corresponds to the size and shape of the outer surface 124 of the suppressor portion 123 of the muzzle device 110.

Optionally, a screw aperture 134 is formed at a 6 o'clock or other position through the blast sleeve 130, so as to be aligned with the at least partially internally threaded screw recess 125 in the muzzle device 110. In this manner, an anti-rotation screw 145 can be positioned between the aligned screw aperture 134 and screw recess 125 to resist rotation of the blast sleeve 130 relative to the muzzle device 110. This may also aid in removal of linear movement of the blast sleeve 130 relative to the muzzle device 110, particularly due to effects of thermal growth.

In various exemplary embodiments, the anti-rotation screw 145 is selected so as to be received a sufficient distance within the screw aperture 134 and screw recess 125 such that a top of the anti-rotation screw 145 is at least flush with, and potentially below, the outer blast sleeve sidewall 137 of the blast sleeve 130. In this manner, the anti-rotation screw 145 does not extend beyond an outer blast sleeve sidewall 137 of the blast sleeve 130, when appropriately fitted within the screw aperture 134 and screw recess 125.

While the muzzle device 110 is shown having a single screw recesses 125 and the blast sleeve 130 is shown having a single screw aperture 134, it should be understood that this is merely exemplary and not limiting. Thus, the number of corresponding screw recesses 125 and screw apertures 134 is a design choice and may be varied.

One or more venting ports 138 are formed through the blast sleeve body 133 so as to allow fluid communication between the blast sleeve borehole 135 and the outer blast sleeve sidewall 137 of the blast sleeve 130. Thus, the one or more venting ports 138 allow fluid communication between the blast sleeve borehole 135 of the blast sleeve 130 and the outside surface of the blast sleeve 130.

In various exemplary embodiments, the venting ports 138 are formed at an acute angle Θ1 relative to one another. Each venting port 138 is formed at the same angle Θ1 as the angles at which the venting apertures 108 are formed.

As illustrated, the venting ports 138 have a substantially cylindrical or oblong shape. Alternatively, one or more of the venting ports 138 may be tapered or reversed tapered and may take on other shapes. Thus, it should be understood that the overall angle, diameter, size, and shape of each venting port 138 is a design choice based upon the desired functionality (i.e. fluid capacity, fluid flow characteristics, etc.) of the blast.

In certain exemplary embodiments, the muzzle device 110 is formed of 4140 heat treated steel and is optionally Nitride (black) coated. The blast sleeve 130 may optionally be formed of Nitrided steel (black), bead blasted SS steel (silver), or TiN coated (gold) steel. Alternate materials of construction of the various components of the muzzle device 110 and/or blast sleeve 130 may include one or more of the following: steel, stainless steel, aluminum, titanium, and/or other metals, as well as various alloys, combinations, and/or composites thereof. Thus, it should be understood that the material or materials used to form the muzzle device 110 and/or blast sleeve 130 is a design choice based on the desired appearance, strength, and functionality of the muzzle device 110 and/or blast sleeve 130.

During attachment or coupling of the blast sleeve 130 to the muzzle device 110, as illustrated most clearly in FIGS. 21-32, as a user begins to attach or couple the blast sleeve 130 to the muzzle device 110, the blast sleeve borehole 135 of the blast sleeve 130 is aligned with the muzzle device first end 111 of the muzzle device 110 and the blast sleeve second end 132 of the blast sleeve 130 is urged over the muzzle device 110.

As the muzzle device 110 is inserted further into the blast sleeve borehole 135 of the blast sleeve 130 (from the blast sleeve second end 132 toward the blast sleeve first end 131), the outer surface 124 of the muzzle device 110 will contact the inner sleeve sidewall of the blast sleeve borehole 135. The shape of the inner sleeve sidewall allows fourth frictional engagement between the outer surface 124 of the muzzle device 110 and the inner sleeve sidewall of the blast sleeve 130.

As the muzzle device 110 is further positioned within the blast sleeve borehole 135 of the blast sleeve 130, the blast sleeve 130 will be appropriately positioned relative to the suppressor portion 123 of the muzzle device 110 and the screw aperture 134 will be aligned with the screw recess 125.

When the blast sleeve 130 is appropriately positioned relative to the muzzle device 110, the anti-rotation screw 145 can be positioned through the screw aperture 134 and threadedly received within at least a portion of the aligned screw recess 125. When the blast sleeve 130 is secured in place, rotational or longitudinal urging or pulling forces applied to the blast sleeve 130 will not remove the blast sleeve 130 from the muzzle device 110 unless the anti-rotation screw 145 is withdrawn a sufficient distance from the screw recess 125.

When the blast sleeve 130 is appropriately secured to the muzzle device 110, the venting ports 138 are appropriately aligned with venting apertures 108 so as to allow fluid communication between the muzzle device borehole 105, via the aligned venting ports 138 and the venting apertures 108, to the exterior of the blast sleeve 130. Thus, blast propellant gases are able to exit from the muzzle device borehole 105, through the aligned venting ports 138 and the venting apertures 108, to the exterior of the blast sleeve 130.

Because of the tight frictional engagement between the inner sleeve sidewall and the outer surface 124 of the muzzle device 110, when the blast sleeve 130 is appropriately secured to the muzzle device 110, propellant gases that travel through venting apertures 108 and venting recesses 109 that are covered by the inner sleeve sidewall of the blast sleeve 130 are urged against the inner sleeve sidewall and directed through aligned or intersecting venting troughs 106, to be directed and expelled from the muzzle device first end 111, via the open terminating ends of the venting troughs 106. Thus, certain of the propellant gases are all contained within the blast sleeve 130 and directed through the venting troughs 106. When positioned around the muzzle device 110, the blast sleeve 130 vents propellant gases forward, between the inner blast sleeve sidewall 136 of the blast sleeve 130 and the venting troughs 106, parallel to the main borehole.

In various exemplary embodiments, two venting ports 138 are formed through the blast sleeve 130. When the blast sleeve 130 is aligned with the muzzle device 110, two of the venting ports 138 are each aligned with a corresponding venting aperture 108. As the propellant gases are expelled through the venting ports 138, the expelled gases provide a vertical muzzle rise mitigation factor to the muzzle device system 100.

In various exemplary embodiments, the blast sleeve 130 is tight-tolerance, press fit onto the muzzle device 110.

It should also be appreciated that a more detailed explanation of the muzzle device 110, further considerations for selecting an appropriate muzzle device 110, instructions regarding the use and operation of the muzzle device 110 and/or blast sleeve 130, and certain other items and/or techniques necessary for the implementation and/or operation of the muzzle device 110 and blast sleeve 130 are not provided herein because such information will be understood by one of ordinary skill in the art. Therefore, it is believed that the level of description provided herein is sufficient to enable one of ordinary skill in the art to understand and practice the present disclosure, as described.

While this invention has been described in conjunction with the exemplary embodiments outlined above, the foregoing description of exemplary embodiments of the present disclosure, as set forth above, are intended to be illustrative, not limiting and the fundamental invention should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "the", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle device and blast sleeve system, comprising:

a muzzle device formed of a portion of substantially cylindrical material that defines a muzzle device body having an attachment portion and a suppressor portion, wherein a muzzle device borehole is formed through said muzzle device, wherein one or more venting apertures extend between said muzzle device borehole and an outer surface of said muzzle device so as to allow fluid communication between said muzzle device borehole and an exterior of said muzzle device, wherein a series of grouped venting apertures are positioned along said suppressor portion of said muzzle device at spaced apart locations and wherein each series of grouped venting apertures is positioned radially or angularly from each subsequent series of grouped venting apertures, wherein at least one venting trough is formed so as to extend from or through each venting aperture to said muzzle device first end of said muzzle device, wherein a venting recess is formed around at least a portion of each venting aperture, and wherein at least one at least partially internally threaded screw recess extends into at least a portion of said muzzle device body;

a blast sleeve formed of a substantially cylindrical material that defines an outer blast sleeve sidewall, wherein a blast sleeve borehole extends through said blast sleeve and is defined by an inner blast sleeve sidewall, wherein said blast sleeve borehole has an inner diameter and shape, which matingly corresponds to and allows for frictional engagement between at least a portion of said outer surface of said muzzle device and at least a portion of said inner blast sleeve sidewall if said muzzle device is at least partially positioned within said blast sleeve borehole, wherein a screw aperture is formed through said blast sleeve, and wherein one or more venting ports are formed through said blast sleeve so as to allow fluid communication between said blast sleeve borehole and said outer blast sleeve sidewall, such that if said blast sleeve is aligned with said muzzle device, said venting ports are aligned with at least two of said venting apertures; and an anti-rotation screw, wherein if said blast sleeve is aligned with said muzzle device, said screw aperture is aligned with said screw recess and said anti-rotation screw can be positioned through said screw aperture and threadedly received within at least a portion of said screw recess.

2. The muzzle device and blast sleeve of claim 1, wherein an outer diameter of said attachment portion is less than an outer diameter of said suppressor portion.

3. The muzzle device and blast sleeve of claim 1, wherein an outer diameter of said attachment portion is substantially similar to or greater than said outer diameter of said suppressor portion.

4. The muzzle device and blast sleeve of claim 1, wherein said venting apertures extend radially from said muzzle device borehole and are formed at an acute angle relative to one another.

5. The muzzle device and blast sleeve of claim 1, wherein each of said grouped venting apertures in said series of grouped venting apertures is equally spaced from each other series of grouped venting apertures, along a longitudinal axis of said suppressor portion of said muzzle device.

6. The muzzle device and blast sleeve of claim 1, wherein sidewalls of each venting aperture are substantially smooth.

7. The muzzle device and blast sleeve of claim 1, wherein sidewalls of each venting aperture our at least partially internally threaded.

8. The muzzle device and blast sleeve of claim 1, wherein each venting trough extends from said outer surface of said muzzle device, toward said muzzle device borehole.

9. The muzzle device and blast sleeve of claim 1, wherein each venting trough extends substantially parallel to a longitudinal axis of said muzzle device.

10. The muzzle device and blast sleeve of claim 1, wherein at least one venting trough intersects or extends between aligned venting apertures.

11. The muzzle device and blast sleeve of claim 1, wherein at least two of said venting troughs are formed at different diametral heights or depths from said outer surface of said muzzle device.

12. The muzzle device and blast sleeve of claim 1, wherein said venting troughs are formed so as to extend from equally spaced apart locations around an outer perimeter of said muzzle device and so as to extend radially inward from said outer surface of said muzzle device toward said muzzle device borehole.

13. The muzzle device and blast sleeve of claim 1, wherein each venting recess comprises an elongate, substantially cylindrical, or oblong shape recess, extending substantially perpendicular to a longitudinal axis of said muzzle device.

14. The muzzle device and blast sleeve of claim 1, wherein sidewalls of each venting recess and/or venting trough are substantially smooth.

15. The muzzle device and blast sleeve of claim 1, wherein sidewalls of each venting recess and/or venting trough are at least partially internally threaded.

16. The muzzle device and blast sleeve of claim 1, wherein said screw recess is formed at a 6 o'clock position of said muzzle device body and wherein said screw aperture is formed at a 6 o'clock position of said blast sleeve.

17. The muzzle device and blast sleeve of claim 1, wherein said venting ports have a substantially cylindrical or oblong shape.

18. The muzzle device and blast sleeve of claim 1, wherein if said blast sleeve is secured to said muzzle device, said venting ports are aligned with venting apertures so as to allow fluid communication between said muzzle device borehole, via said aligned venting ports and said venting apertures, to said exterior of said blast sleeve.

19. A muzzle device and blast sleeve system, comprising:

a muzzle device having an attachment portion and a suppressor portion, wherein a muzzle device borehole is formed through said muzzle device, wherein one or more venting apertures extend between said muzzle device borehole and an outer surface of said muzzle device so as to allow fluid communication between said muzzle device borehole and an exterior of said muzzle device, wherein a series of grouped venting apertures are positioned along said suppressor portion of said muzzle device at spaced apart locations and wherein each series of grouped venting apertures is positioned radially or angularly from each subsequent series of grouped venting apertures, wherein at least one venting trough is formed so as to extend, substantially parallel to a longitudinal axis of said muzzle device borehole, from or through each venting aperture to said muzzle device first end of said muzzle device, wherein a venting recess is formed around at least a portion of each venting aperture, and wherein at least one at least partially internally threaded screw recess extends into at least a portion of said muzzle device;

a substantially cylindrical blast sleeve, wherein a blast sleeve borehole extends through said blast sleeve and is defined by an inner blast sleeve sidewall, wherein said blast sleeve borehole has an inner diameter and shape, which matingly corresponds to and allows for frictional engagement between at least a portion of said outer surface of said muzzle device and at least a portion of said inner blast sleeve sidewall if said muzzle device is at least partially positioned within said blast sleeve borehole, wherein a screw aperture is formed through said blast sleeve, and wherein one or more venting ports are formed through said blast sleeve so as to allow fluid communication between said blast sleeve borehole and an outer blast sleeve sidewall, such that if said blast sleeve is aligned with said muzzle device, said venting ports are aligned with at least two of said venting apertures; and an anti-rotation screw, wherein if said blast sleeve is aligned with said muzzle device, said screw aperture is aligned with said screw recess and said anti-rotation screw can be positioned through said screw aperture and threadedly received within at least a portion of said screw recess.

20. A muzzle device and blast sleeve system, comprising:

a muzzle device having an attachment portion and a suppressor portion, wherein a muzzle device borehole is formed through said muzzle device, wherein one or more venting apertures extend between said muzzle device borehole and an outer surface of said muzzle device between said muzzle device borehole and an exterior of said muzzle device, wherein a series of grouped venting apertures are positioned along said suppressor portion of said muzzle device at spaced apart locations and wherein each series of grouped venting apertures is positioned radially or angularly from each subsequent series of grouped venting apertures, wherein at least one venting trough is formed so as to extend, substantially parallel to a longitudinal axis of said muzzle device borehole, from or through each venting aperture to said muzzle device first end of said muzzle device, and wherein a venting recess is formed around at least a portion of each venting aperture; and a substantially cylindrical blast sleeve, wherein a blast sleeve borehole extends through said blast sleeve and is defined by an inner blast sleeve sidewall, wherein said blast sleeve borehole has an inner diameter and shape, which allows for frictional engagement between at least a portion of said outer surface of said muzzle device and at least a portion of said inner blast sleeve sidewall if said muzzle device is at least partially positioned within said blast sleeve borehole, and wherein one or more venting ports are formed through said blast sleeve between said blast sleeve borehole and an outer blast sleeve sidewall, such that if said blast sleeve is aligned with said muzzle device, said venting ports are aligned with at least two of said venting apertures.

* * * * *